US012156567B2

(12) United States Patent
Campos, II et al.

(10) Patent No.: US 12,156,567 B2
(45) **Date of Patent: *Dec. 3, 2024**

(54) SOLE STRUCTURE FOR ARTICLE OF FOOTWEAR

(71) Applicant: NIKE, Inc., Beaverton, OR (US)

(72) Inventors: Fidencio Campos, II, Dallas, OR (US); Wesley K. Chan, Portland, OR (US); Zachary M. Elder, Portland, OR (US); Elizabeth Langvin, Sherwood, OR (US); Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/156,600

(22) Filed: Jan. 19, 2023

(65) Prior Publication Data

US 2023/0148705 A1 May 18, 2023

Related U.S. Application Data

(63) Continuation of application No. 16/771,706, filed as application No. PCT/US2018/065066 on Dec. 12, 2018, now Pat. No. 11,564,445.

(Continued)

(51) Int. Cl.

| | |
|---|---|
| ***A43B 13/18*** | (2006.01) |
| ***A43B 13/14*** | (2006.01) |
| ***A43B 13/20*** | (2006.01) |

(52) U.S. Cl.

CPC ..... *A43B 13/186* (2013.01); *A43B 13/14* (2013.01); *A43B 13/189* (2013.01); *A43B 13/20* (2013.01); *A43B 13/206* (2013.01)

(58) Field of Classification Search

CPC ..... A43B 13/20; A43B 13/206; A43B 13/186; A43B 13/189; A43B 3/0057

(Continued)

(56) References Cited

U.S. PATENT DOCUMENTS 2,080,499 A * 5/1937 Nathansohn ..... A43B 17/03 36/153
4,219,945 A 9/1980 Rudy (Continued)

FOREIGN PATENT DOCUMENTS

CN 1372443 A 10/2002
CN 1638663 A 7/2005

(Continued)

OTHER PUBLICATIONS

European Patent Office (ISA), International Search Report and Written Opinion for International Application No. PCT/US2018/065066, mailed Mar. 28, 2019.

(Continued)

*Primary Examiner* — Khoa D Huynh
*Assistant Examiner* — Haley A Smith
(74) *Attorney, Agent, or Firm* — Honigman LLP; Matthew H. Szalach; Jonathan P. O'Brien

(57) ABSTRACT

A sole structure for an article of footwear having an upper includes a heel region, a forefoot region, and a mid-foot region disposed between the heel region and the forefoot region. The sole structure also includes a fluid-filled chamber including a first barrier layer cooperating with a second barrier layer to define a first segment extending between a medial side of the sole structure and a lateral side of the sole structure within the forefoot region, a second segment extending between the medial side of the sole structure and the lateral side of the sole structure within the forefoot region, and a web area disposed between and connecting the first segment and the second segment, the first barrier layer being attached to the second barrier layer within the web area.

16 Claims, 9 Drawing Sheets

Related U.S. Application Data

(60) Provisional application No. 62/598,782, filed on Dec. 14, 2017.

(58) Field of Classification Search
USPC ..... 36/29; D2/591
See application file for complete search history.

(56) References Cited

U.S. PATENT DOCUMENTS

| | | | | |
|---|---|---|---|---|
| 5,042,176 | A | 8/1991 | Rudy | |
| 5,595,004 | A * | 1/1997 | Lyden | A43B 13/20 36/35 B |
| 5,598,645 | A | 2/1997 | Kaiser | |
| 5,956,869 | A * | 9/1999 | Kim | A43B 13/20 36/28 |
| 6,571,490 | B2 | 6/2003 | Tawney et al. | |
| 6,971,193 | B1 * | 12/2005 | Potter | A43B 13/203 36/141 |
| 9,420,848 | B2 | 8/2016 | Campos, II et al. | |
| 9,750,307 | B2 | 9/2017 | Campos, II | |
| 10,555,580 | B2 | 2/2020 | Peyton | |
| 10,905,194 | B2 | 2/2021 | Greene | |
| 2001/0042321 | A1 | 11/2001 | Tawney et al. | |
| 2003/0172549 | A1 * | 9/2003 | Soren | A43B 17/03 36/29 |
| 2006/0042120 | A1 * | 3/2006 | Sokolowski | A43B 13/187 36/28 |
| 2012/0174432 | A1 * | 7/2012 | Peyton | A43B 13/188 36/31 |
| 2014/0230276 | A1 | 8/2014 | Campos II et al. | |
| 2015/0257481 | A1 | 9/2015 | Campos, II et al. | |
| 2015/0272271 | A1 | 10/2015 | Campos, II et al. | |
| 2016/0021974 | A1 * | 1/2016 | Schindler | A43B 13/223 12/146 B |
| 2016/0192737 | A1 * | 7/2016 | Campos, II | B32B 27/40 12/146 B |
| 2017/0013915 | A1 | 1/2017 | Caston, Jr. | |
| 2017/0119095 | A1 * | 5/2017 | Greene | B29D 35/142 |
| 2017/0265564 | A1 | 9/2017 | Peyton | |
| 2017/0265565 | A1 | 9/2017 | Connell et al. | |
| 2017/0265566 | A1 | 9/2017 | Case et al. | |
| 2018/0303201 | A1 | 10/2018 | Greene | |

FOREIGN PATENT DOCUMENTS

| | | | |
|---|---|---|---|
| WO | WO-0170064 | A2 | 9/2001 |
| WO | WO-2016/144538 | A1 | 9/2016 |
| WO | WO-2017079255 | A1 | 5/2017 |
| WO | WO-2017/160729 | A1 | 9/2017 |
| WO | WO-2017160943 | A1 | 9/2017 |
| WO | WO-2017160946 | A1 | 9/2017 |

OTHER PUBLICATIONS

Japan Patent Office, First Office Action dated Aug. 10, 2021 for application No. 2020-532635.
China National Intellectual Property Administration, Second Office Action dated Sep. 13, 2021 for application No. 201880088433.3.
Korean Intellectual Property Office, Office Action for application No. 10-2020-7019780 mailed Sep. 14, 2021.
Taiwan Patent Office, Search Report for Application No. 107142277 mailed Mar. 20, 2020.
European Patent Office, Office Action for Application No. 18840103.8 mailed May 31, 2022.
China National Intellectual Property Administration, First Office Action for Application No. 201880088433.3 mailed Apr. 21, 2021.
USPTO, Final Office Action for U.S. Appl. No. 16/771,706, mailed Jun. 9, 2022.
USPTO, Non-Final Office Action for U.S. Appl. No. 16/771,706, mailed Feb. 4, 2022.
USPTO, Non-Final Office Action for U.S. Appl. No. 16/771,706, mailed Jul. 26, 2021.
USPTO, Final Office Action for U.S. Appl. No. 18/156,787, mailed Mar. 4, 2024.
The State Intellectual Property Office of PRC, Office Action dated Jun. 28, 2024 for App. No. 202210534888.1.

* cited by examiner

SOLE STRUCTURE FOR ARTICLE OF FOOTWEAR

CROSS REFERENCE TO RELATED APPLICATIONS

This application is a continuation of U.S. application Ser. No. 16/771,706, filed Jun. 11, 2020, which is a national phase entry of PCT International Application No. PCT/US2018/065066, filed Dec. 12, 2018, which claims priority to U.S. Provisional Ser. No. 62/598,782, filed Dec. 14, 2017, the contents of which are hereby incorporated by reference in their entireties.

FIELD

The present disclosure relates generally to sole structures for articles of footwear and more particularly to sole structures incorporating a fluid-filled chamber having a plurality of segments.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
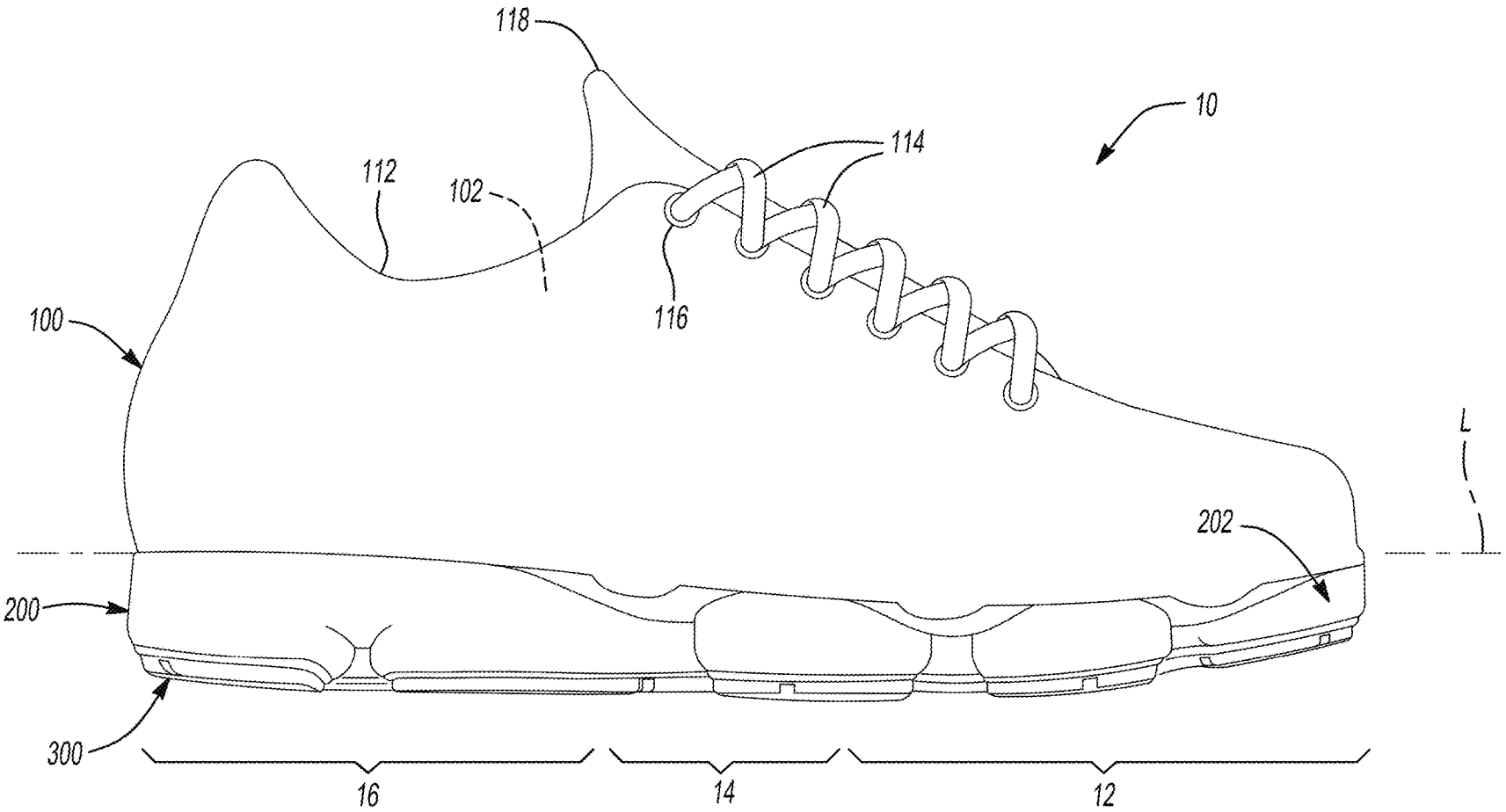
FIG. 1 is a side perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear. The structure includes a heel region, a forefoot region, and a mid-foot region disposed between the heel region and the forefoot region. The structure also includes a bladder including a first barrier layer cooperating with a second barrier layer to define a first chamber having a first segment extending along one of a medial side of the sole structure and a lateral side of the sole structure, a second segment extending from a first end of the first segment to the other of the medial side and the lateral side, a third segment extending from a second end of the first segment to the other of the medial side and the lateral side and diverging from the second segment, a fourth segment extending towards the heel region from one of the second segment and the third segment along the other of the medial side and the lateral side, and a fifth segment extending from the fourth segment towards the one of the medial side and the lateral side and terminating at a distal end between the medial side and the lateral side.

Implementations of the disclosure may include one or more of the following optional features. In some implementations, the fourth segments extends from the second segment and the fifth segment extends between the second segment and the third segment. Here, the fifth segment may extend parallel to the third segment and may converge with the second segment along a direction from the other of the medial side and the lateral side to the one of the medial side and the lateral side.

In some configurations, the fourth segment extends from the third segment and the third segment extends between the second segment and the fifth segment. Here, the fifth segment may be convergent with the second segment and the third segment in a direction from the other of the medial side and the lateral side to the one of the medial side and the lateral side. Optionally, the distal end of the fifth segment may taper in a direction toward the upper.

In some examples, the first chamber includes a sixth segment extending towards the heel region from the other of the second segment and the third segment. The first chamber may also include a seventh segment extending from the sixth segment towards the one of the medial side and the lateral side and terminating at a distal end between the medial side and the lateral side. In this example, the fifth segment may extend between the second segment and the third segment and the second segment is disposed between the fifth segment and the seventh segment. Optionally, the bladder of the sole structure may include a second chamber surrounding the heel region of the sole structure.

Another aspect of the disclosure provides a sole structure for an article of footwear. The sole structure includes a heel region, a forefoot region including a toe portion, and a mid-foot region disposed between the heel region and the forefoot region. The sole structure also includes a bladder including a first barrier layer cooperating with a second barrier layer to define a first chamber having a serpentine shape extending from a medial side of the sole structure to a lateral side of the sole structure within the forefoot region, a second chamber bounding a periphery of the heel region, a third chamber formed in the toe portion of the forefoot region, and a web area disposed between and connecting the first chamber, the second chamber, and the third chamber. The first barrier layer is attached to the second barrier layer within the web area.

Implementations of the disclosure may include one or more of the following optional features. In some configurations, the first chamber is fluidly connected to the second chamber by a first conduit along the medial side and the third chamber is fluidly connected to the second chamber by a second conduit along the medial side.

In some examples, the first chamber includes a first segment extending along one of the medial side and the lateral side, a second segment extending from a first end of the first segment to the other of the medial side and the lateral side, a third segment extending from a second end of the first segment to the other of the medial side and the lateral side and diverging from the second segment, a fourth segment extending towards the heel region from one of the second segment and the third segment along the other of the medial side and the lateral side, and a fifth segment extending from the fourth segment towards the one of the medial side and the lateral side and terminating at a distal end between the medial side and the lateral side. Here, the third chamber may include a fifth segment extending around the toe portion from the one of the medial side and the lateral side to the other of the medial side and the lateral side, and a sixth segment extending from the fifth segment on the other of the medial side and the lateral side and towards the one of the medial side and the lateral side. The sixth segment may terminate at a distal end between the medial side and the lateral side. Additionally or alternatively, the sixth segment may be parallel to the second segment. The second chamber may also include a fifth segment extending from the mid-foot region through the heel region along one of the medial side and the lateral side, a sixth segment extending from the first segment in the mid-foot region to the other of the medial side and the lateral side in the heel region, and a seventh segment extending around the heel region and fluidly coupling the fifth segment to the sixth segment. Here, the seventh segment may be fluidly coupled to the fifth segment by a third conduit and the seventh segment may be fluidly coupled to the sixth segment by a fourth conduit.

In some implementations, the sole structure also includes an outsole attached to at least one of the first chamber, the second chamber, and the third chamber and defining a ground-engaging surface. In this example, the web area may be recessed from the ground-engaging surface.

Figure 2:
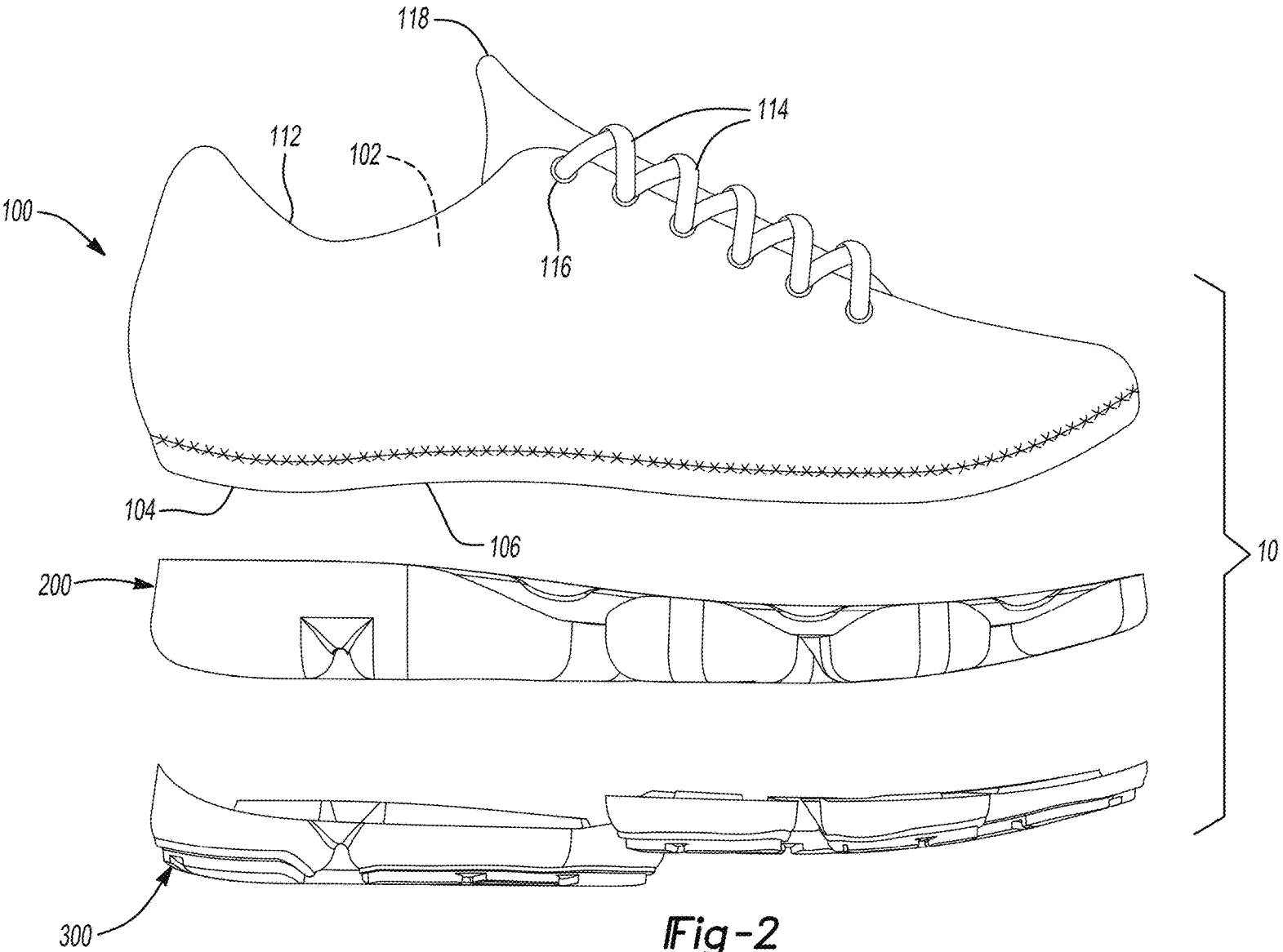
FIG. 2 is an exploded view of the article of footwear of FIG. 1, showing a sole structure having a midsole, a fluid-filled chamber, and an outsole arranged in a layered configuration.

Referring to FIGS. 1 and 2, an article of footwear 10 includes an upper 100, a midsole 200 attached to the upper 100, and an outsole 300 extending between the midsole 200 and a ground surface. The article of footwear 10 may be divided into one or more regions. The regions may include a forefoot region 12, a mid-foot region 14, and a heel region 16. The forefoot region 12 may correspond with toes and joints connecting metatarsal bones with phalanx bones of a foot. The mid-foot region 14 may correspond with an arch area of the foot, and the heel region 16 may correspond with rear portions of the foot, including a calcaneus bone. The footwear 10 may include lateral and medial sides 18, 20, respectively, corresponding with opposite sides of the footwear 10 and extending through the regions 12, 14, 16.

The upper 100 includes interior surfaces that define an interior void 102 configured to receive and secure a foot for support on the midsole 200. The upper 100 may be formed from one or more materials that are stitched or adhesively bonded together to form the interior void 102. Suitable materials of the upper may include, but are not limited to, mesh, textiles, foam, leather, and synthetic leather. The materials may be selected and located to impart properties of durability, air-permeability, wear-resistance, flexibility, and comfort.

Figure 4:
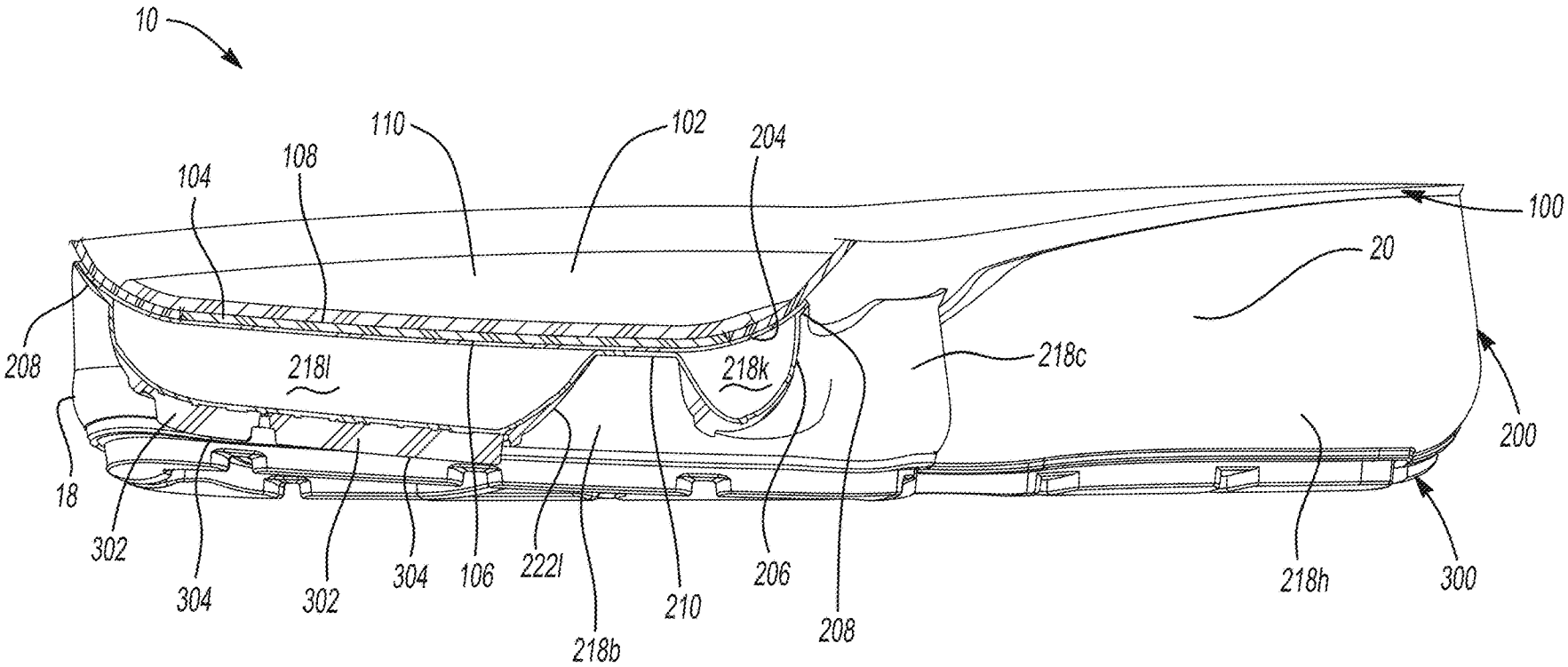
FIG. 4 is a cross-sectional view taken along line 4-4 of FIG. 3, showing a segment within a forefoot region of a sole structure and extending between a lateral side of the sole structure and the medial side of a sole structure and terminating at a distal end.

In some examples, the upper 100 includes a strobel 104 having a bottom surface 106 opposing the midsole 200 and an opposing top surface defining a footbed 108 of the interior void 102. Stitching or adhesives may secure the strobel 104 to the upper 100. As shown in FIG. 4, the footbed 108 may be contoured to conform to a profile of the bottom surface (e.g., plantar) of the foot. Optionally, the upper 100 may also incorporate additional layers such as an insole 110 or sockliner that may be disposed upon the strobel 104 and reside within the interior void 102 of the upper 100 to receive a plantar surface of the foot to enhance the comfort of the article of footwear 10. An ankle opening 112 in the heel region 16 may provide access to the interior void 102. For example, the ankle opening 112 may receive a foot to secure the foot within the void 102 and facilitate entry and removal of the foot from and to the interior void 102.

In some examples, one or more fasteners 114 extend along the upper 100 to adjust a fit of the interior void 102 around the foot and to accommodate entry and removal of the foot therefrom. The upper 100 may include apertures 116 such as eyelets and/or other engagement features such as fabric or mesh loops that receive the fasteners 114. The fasteners 114 may include laces, straps, cords, hook-and-loop, or any other suitable type of fastener. The upper 100 may include a tongue portion 118 that extends between the interior void 102 and the fasteners 114.

As shown FIGS. 4-7, the midsole 200 includes a bladder 202 defined by an upper barrier layer 204 (hereinafter 'upper layer 204') and a lower barrier layer 206 (hereinafter 'lower layer 206'). The upper layer 204 and the lower layer 206 define barrier layers for the bladder 202 by joining together and bonding at a plurality of discrete locations during a molding or thermoforming process to form a flange 208 extending around the periphery of the midsole 200 and a web area 210 extending between the lateral and medial sides 18 and 20 of the midsole 200. The flange 208 and the web area 210 are disposed proximate to the upper 100 and, thus, are recessed relative to a ground-contacting surface 304 of the outsole 300.

The upper layer 204 of the bladder 202 opposes and attaches (e.g., joins and bonds) to the bottom surface 106 of the strobel 104 of the upper 100. Additionally, the upper layer 204 of the bladder 202 may be contoured to conform to a profile of the bottom surface of the foot to provide cushioning and support for the foot. The upper layer 204 may be formed from one or more polymer materials during a molding process or a thermoforming process and may include an outer peripheral edge that extends upward upon an outer periphery of the upper 100. The lower layer 206 of the bladder 202 is disposed on an opposite side of the bladder 202 than the upper layer 204. The lower layer 206 may include an outer peripheral edge that extends upward toward the upper 100 and bonds with the outer peripheral edge of the upper layer 204 to form the flange 208. As with the upper layer 204, the lower layer 206 may be formed from the same or a different polymer material during the molding or thermoforming process.

In some implementations, the upper and lower layers 204, 206 are formed by respective mold portions each defining various surfaces for forming depressions and pinched surfaces corresponding to locations where the flange 208 and/or the web area 210 are formed when the lower layer 206 and the upper layer 204 join and bond together. In some implementations, adhesive bonding joins the upper layer 204 and the lower layer 206 to form the flange 208 and the web area 210. In other implementations, the upper layer 204 and the lower layer 206 are joined to form the flange 208 and the web area 210 by thermal bonding. In some examples, one or both of the upper and lower layers 204, 206 are heated to a temperature that facilitates shaping and melding. In some examples, the layers 204, 206 are heated prior to being located between their respective molds. In other examples, the mold may be heated to raise the temperature of the layers 204, 206. In some implementations, a molding process used to form the bladder 202 incorporates vacuum ports within mold portions to remove air such that the upper and lower layers 204, 206 are drawn into contact with respective mold portions. In other implementations, fluids such as air may be injected into areas between the upper and lower layers 204, 206 such that pressure increases cause the layers 204, 206 to engage with surfaces of their respective mold portions.

The midsole 200 may include a polymer foam layer (not shown) disposed between the upper layer 204 of the bladder 202 and the upper 100. Thus, the optional foam layer of the midsole 200 is an intermediate layer that indirectly attaches the upper layer 204 of the bladder 202 to the upper 100 by joining the upper layer 204 of the bladder 202 to the upper 100 and/or to the bottom surface 106 of the strobel 104, thereby securing the midsole 200 and the outsole 300 to the upper 100. Moreover, the foam layer of the footwear 10 may also reduce the extent to which the upper layer 204 extends onto the peripheral surfaces of the upper 100 and, therefore, increases durability of the footwear 10 by reducing the possibility of the upper layer 204 detaching from the upper 100 over extended use of the footwear 10.

Figure 3:
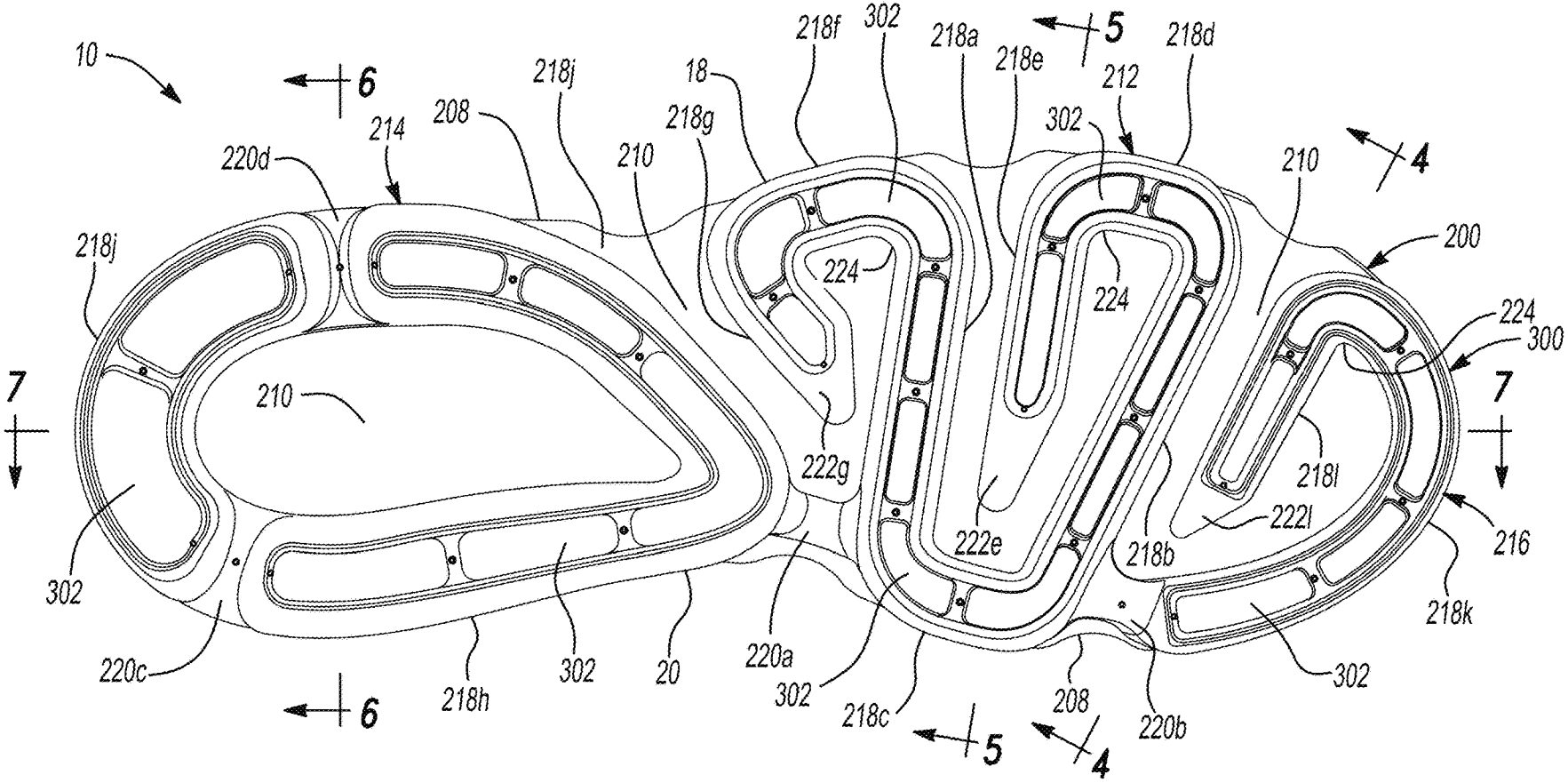
FIG. 3 is a bottom perspective view of the article of footwear of FIG. 1, showing a geometry and configuration of a plurality of chambers associated with a fluid-filled bladder of a sole structure.

Referring to FIG. 3, the bladder 202 includes one or more chambers 212, 214, 216. In the illustrated example, a first chamber 212 extends from the mid-foot region 14 to a toe portion of the forefoot region 12, a second chamber 214 extends through the heel region 16, and a third chamber 216 is formed in the toe portion of the forefoot region 12. The second chamber 214 is fluidly coupled to the first chamber 212 by a first conduit **220*a* and the third chamber 216 is fluidly coupled to the first chamber 212 by a second 220*b***, as described in greater detail below.

The chambers 212, 214, 216 are each defined by a plurality of segments **218*a*-218*l*, which are fluidly coupled to each other by one or more of the conduits 220*a*-220*d*. In some implementations, the lower layer 206 defines a geometry (e.g., thicknesses, width, and lengths) of the plurality of segments 218***a*-218*l* and the conduits 220*a*-220*d*. The lower layer 206 and the upper layer 204 may join and bond together in a plurality of discrete areas between the lateral side 18 and the medial side 20 of the bladder 202 to form portions of the web area 210 that bound and separate each segment 218*a*-218*l* and conduit 220*a*-220*d*. Thus, each segment 218*a*-218*l* and conduit 220*a*-220*d* is associated with an area of the bladder 202 where the upper and lower layers 204, 206 are not joined together and, thus, are separated from one another to form respective voids.

The flange 208 and the web area 210 may cooperate to bound and extend around each of the segments 218*a*-218*l* to seal the fluid (e.g., air) within the segments 218*a*-218*l*. In some examples, regions of the web area 210 are bounded entirely by segments 218*a*-218*l* and/or conduits 220*a*-220*c* while other regions of the web area 210 are bounded by a combination of segments 218*a*-218*l* and/or conduits 220*a*-220*c* along one of the lateral side 18 and the medial side 20, and the flange 208 along the other of the lateral side 18 and the medial side 20. In some configurations, regions of the web area 210 define flexion zones to facilitate flexing of the footwear 10 as the midsole 200 rolls along the ground surface. As shown in FIG. 3, no portion of the web area 210 extends continuously between the lateral side 18 and the medial side 20.

Figure 5:
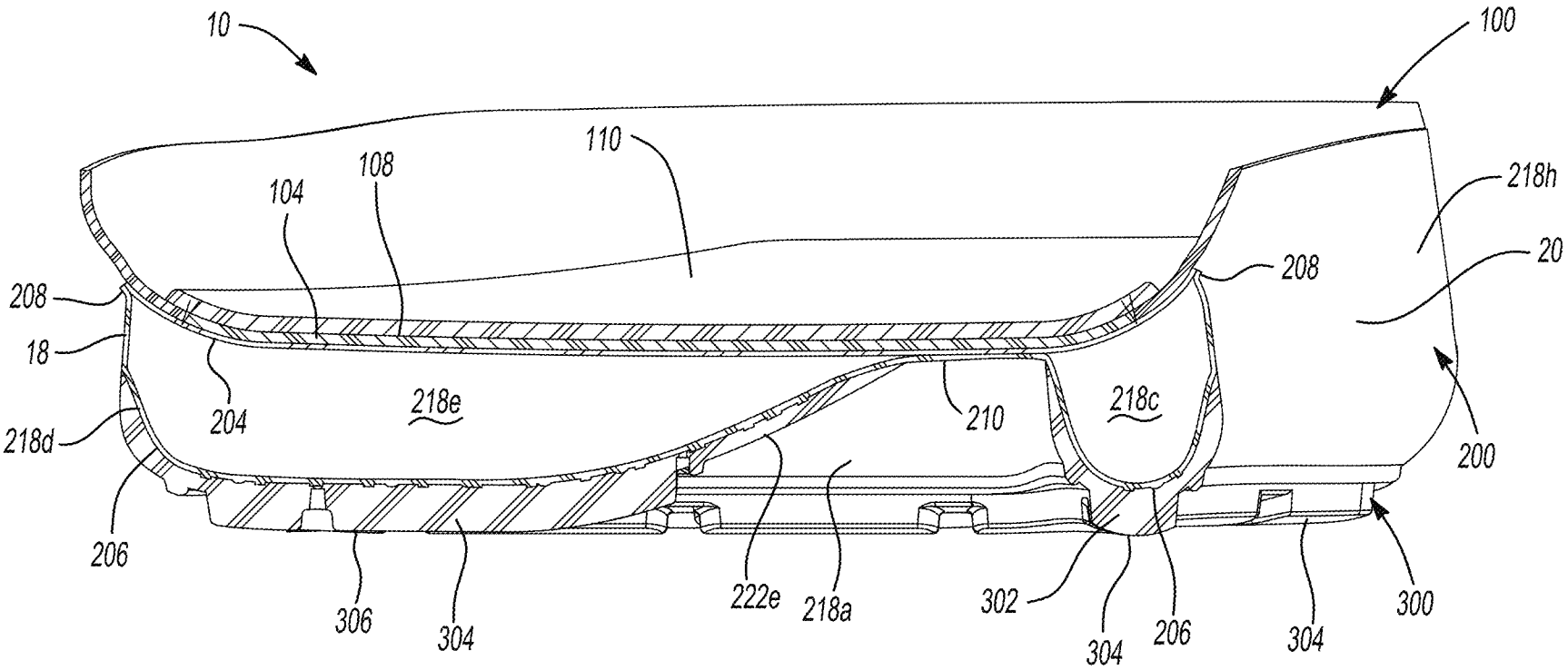
FIG. 5 is a cross-sectional view taken along line 5-5 of FIG. 3, showing a segment within a forefoot region of a sole structure and extending between a lateral side of the sole structure and the medial side of a sole structure and terminating at a distal end.
Figure 6:
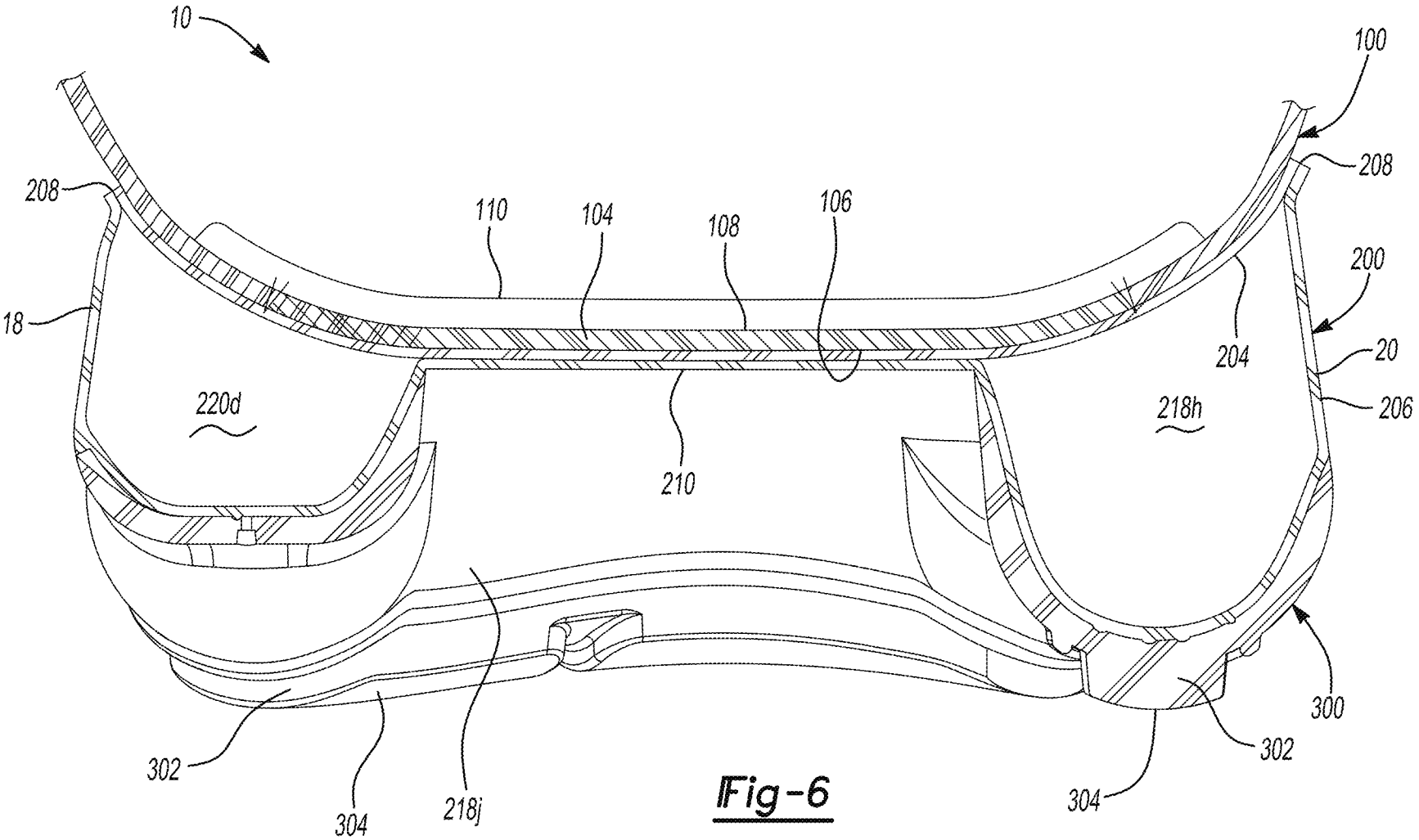
FIG. 6 is a cross-sectional view taken along line 6-6 of FIG. 3, showing segments disposed within a heel region of the sole structure and separated from one another by a web area.
Figure 7:
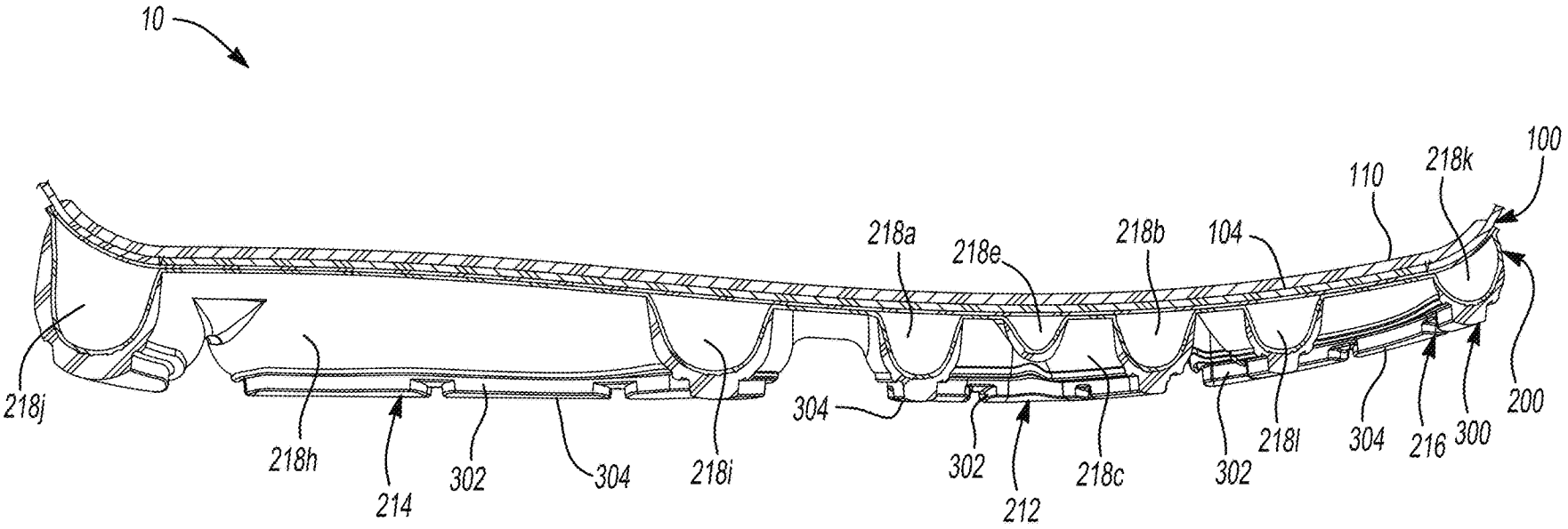
FIG. 7 is a cross-sectional view taken along line 7-7 of FIG. 3, showing segment spaced along the sole structure and disposed in the forefoot region, mid-foot region, and heel region and separated from one another by a web area.

As shown in FIGS. 4-7, each segment 218*a*-218*l* may define a substantially tubular cross-sectional shape and a thickness that extends substantially perpendicular to the longitudinal axis L of the midsole 200 between the upper layer 204 and the lower layer 206. As such, the thickness of each segment 218*a*-218*l* is defined by a distance the lower layer 206 protrudes away from the upper layer 204 in a direction away from the upper 100. At least two of the segments 218*a*-218*l* may define different thicknesses. For example, one or more segments 218*h*-218*j* disposed in the heel region 16 may be associated with greater thicknesses than thicknesses associated one or more segments 218*a*-218*g* disposed in the forefoot region 12 or the mid-foot region 14. As shown in FIG. 7, a thickness of the midsole 200 gradually decreases from the heel region 16 to the forefoot region 12 to provide a greater degree of cushioning for absorbing ground-reaction forces of greater magnitude that initially occur in the heel region 16 and lessen as the forefoot region 12 of the midsole 200 rolls for engagement with the ground surface.

Each of the segments 218*a*-218*l* and the conduits 220*a*-220*d* may be filled with a pressurized fluid (i.e., gas, liquid) to provide cushioning and stability for the foot during use of the footwear 10. In some implementations, compressibility of a first portion of the plurality of segments 218*a*-218*l* of the chambers 212, 214, 216 under an applied load provides a responsive-type cushioning, while a second portion of the segments 218*a*-218*l* of the chambers 212, 214, 216 may be configured to provide a soft-type cushioning under an applied load. Accordingly, the segments 218*a*-218*l* of the bladder 202 may cooperate to provide gradient cushioning to the article of footwear 10 that changes as the applied load changes (i.e., the greater the load, the more the segments 218*a*-218*l* are compressed and, thus, the more responsive the footwear 10 performs).

In other implementations, one or more cushioning materials, such as polymer foam and/or particulate matter, are enclosed by one or more of the segments 218*a*-218*l* in place of, or in addition to, the pressurized fluid to provide cushioning for the foot. In these implementations, the cushioning materials may provide one or more of the segments 218*a*-218*l* with cushioning properties different from the segments 218*a*-218*l* filled with the pressurized fluid. For example, the cushioning materials may be more or less responsive or provide greater impact absorption than the pressurized fluid.

In some implementations, an overmold portion extends over a portion of the bladder 202 to provide increased durability and resiliency for the chambers 212, 214, 216 when under applied loads. The overmold portion may extend over the forefoot region 12, the mid-foot region 14, and/or the heel region 16 by attaching to the lower layer 206 to provide increased durability and resiliency for the bladder 202 where the separation distance between the lower layer 206 and the upper layer 204 is greater, or to provide increased thickness in specific areas of the bladder 202, such as the heel region 16. In some examples the overmold portion is bonded to the lower layer 206 and includes at least one of a different thickness, a different hardness, and a different material than the lower layer 206. The overmold portion may be limited to only attaching to areas of the lower layer 206 that partially define the segments residing in the forefoot, mid-foot, and heel regions 12, 14, 16 and, therefore, the overmold portion may be absent from the flange 208 and web area 210. Accordingly, the overmold portion may partially define a plurality of the segments 218*a*-218*l*.

The outsole 300 attaches to and conforms in shape with the midsole 200. The outsole 300 may include a plurality of ground contacting pads 302 for defining the ground-contacting surface 304 of the article of footwear 10. In some examples, the contact pads 302 extend from the lower layer 206 of the bladder 202 in a direction away from the upper 100 to provide increased traction with the ground surface. The contact pads 302 may also cause the bottom surface of the foot to reside higher above the ground surface.

In some examples, the outsole 300 includes the ground-engaging surface 304 and an opposite inner surface 306 that attaches to regions of the lower layer 206 that define the segments 218*a*-218*l*. Accordingly, the outsole 300 may include a plurality of segments each defining a shape that conforms to the shape of a respective segments 218*a*-218*l*, whereby the outsole 300 is absent in regions between the segments 218*a*-218*l* to thereby expose the flange 208 and web area 210 of the bladder 202. The outsole 300 generally provides abrasion-resistance and traction with the ground surface and may be formed from one or more materials that impart durability and wear-resistance, as well as enhance traction with the ground surface. For example, rubber may form at least a portion of the outsole 300.

In the illustrated example, the outsole 300 is formed as the overmold portion, as described above. Accordingly, the outsole 300 may be formed integrally with the lower layer 206 of the bladder 202 using an overmolding process. In other examples the outsole 300 may be formed separately from the lower layer 206 of the bladder 202 and may be adhesively bonded to the lower layer 206.

With reference to FIG. 3, the geometry and configuration of the segments 218*a*-218*l* is shown with reference to a bottom perspective view of the footwear 10. At least one of the segments 218*a*-218*l* may have a different length than the other segments 218*a*-218*l*. As described above, the segments 218*a*-218*l* are formed in areas of the midsole 200 where the upper layer 204 and the lower layer 206 are separated and spaced apart from one another to define respective voids for enclosing the pressurized fluid or cushioning material. As such, the flange 208 and the web area 210 correspond to areas of the bladder 202 where the upper layer 204 and the lower layer 206 are joined and bonded, and cooperate to bound and define a perimeter of each segments 218*a*-218*l* to thereby seal the pressurized fluid therein. Accordingly, the segments 218*a*-218*l* may be disposed within corresponding ones of the regions 12, 14, 16 of the midsole 200 and may be spaced apart from one another by the web area 210. In other words, the one or more segments 218*a*-218*l* may cooperate to bound corresponding regions of the web area 210.

In some implementations, at least two of the segments 218*a*-218*l* extend along the lateral side 18 of the midsole 200 while at least two other segments 218*a*-218*l* extend along the medial side 20 of the midsole 200. Moreover, some of the segments 218*a*-218*l* extend between the lateral side 18 of the midsole 200 and the medial side 20 of the midsole 200. For instance, at least one segment 218*a*-218*l* may extend continuously from one of the lateral side 18 and the medial side 20 to the other one of the lateral side 18 and the medial side 20. Additionally or alternatively, at least one of the segments 218*a*-218*l* extends from one of the lateral side 18 and the medial side 20 to a distal end 222 that terminates at a location between the medial side 20 and the lateral side 18. Here, the distal end(s) 222 may taper in a direction toward the upper 100, i.e., the lower layer 206 tapers toward the upper layer 204 of the bladder 202 so the thickness of the segment 218*a*-218*l* decreases along a direction towards the distal end 222.

In some implementations, the segments 218*a*-218*l* are in fluid communication with one another to form a unitary pressure system for the bladder 202. The unitary pressure system directs fluid through the segments 218*a*-218*l* when under an applied load as the segments 218*a*-218*l* compress or expand to provide cushioning, stability, and support by attenuating ground-reaction forces especially during forward running movements of the footwear 10. Optionally, one or more of the segments 218*a*-218*l* may be fluidly isolated from the other segments 218*a*-218*l* so that at least one of the segments 218*a*-218*l* can be pressurized differently.

In some configurations, at least two adjacent segments 218*a*-218*l* are connected to one another at a bend 224 or turn, whereby each of the segments connected by the corresponding bend 224 extend in different directions from one another. Each bend 224 is associated with an internal radius extending toward the periphery of the midsole 200. In some examples, the radius of each bend 224 is at least 3 mm. Moreover, each bend 224 is disposed proximate to the periphery of the midsole 200 on an opposite side of the respective segment 218*a*-218*l* than the flange 208. By positioning the bends 224 on opposite sides of the segments than the flange 208, collapsing by the segments 218*a*-218*l* is restricted during directional shifts between loads applied to the midsole 200.

As shown in FIG. 3, the segments 218*a*-218*g* of the first chamber 212 may cooperate to define a unitary serpentine shape for the first chamber 212 that extends between the distal end 222*e* of the segment 218*e* disposed in the forefoot region 12 and the distal end 222*g* of the segment 218*g* disposed within the mid-foot region 14. More particularly, the unitary serpentine shape of the first chamber 212 extends along the longitudinal axis L of the midsole 200 and includes one or more segments 218*d*, 218*f* extending along the lateral side 18, one or more segments 218*c* extending along the medial side 20, segments 218*a*, 218*b* extending continuously between the lateral side 18 and the medial side 20, as well as segments 218*e*, 218*g* extending toward the medial side 20 to distal ends 222 that terminate at respective distal ends 222*e*, 222*g* between the lateral side 18 and the medial side 20.

In some examples, the first chamber 212 includes a plurality of segments 218*a*-218*g* extending from the forefoot region 12 through the mid-foot region 14. First and second segments 218*a*, 218*b* are disposed within the forefoot region 12 and extend continuously from the lateral side 18 to the medial side 20 of the midsole 200. The second segment 218*b* is disposed forward of the first segment 218*a* with respect to the longitudinal axis L of the midsole 200. The first segment 218*a* and the second segment 218*b* converge with each other in a direction from lateral side 18 to the medial side. A third segment 218*c* extends along the medial side 20 in the forefoot region 12 and includes a first end fluidly coupled to the first segment 218*a* and a second end fluidly coupled to the second segment 218*b* at respective bends 224 of the first chamber 212. The first chamber 212 further includes a fourth segment 218*d* extending from the second segment 218*b* towards the first segment 218*a* along the lateral side 18 of the midsole 200. A fifth segment 218*e* is disposed between the first segment 218*a* and the second segment 218*b* and extends from the fourth segment 218*d*. The fifth segment 218*e* extends towards the medial side 20 from the fourth segment 218*d*, and terminates at a distal end 222*e* between the lateral side 18 and the medial side 20. In some scenarios, the fifth segment 218*e* is substantially parallel to the first segment 218*a* and is convergent with the second segment 218*b* in a direction from the lateral side 18 to the medial side 20. A sixth segment 218*f* extends from the first segment 218 in a direction away from the second segment 218*b* (i.e., towards the heel region) along the lateral side 18. In some examples, the sixth segment 218*f* extends into the mid-foot region 14. A seventh segment 218*g* of the first chamber 212 extends from the sixth segment 218*f* towards the medial side 18 and terminates at a distal end 222*g* between the lateral side 18 and the medial side 20. The seventh segment 218*g* is convergent with the first segment 218*a* in a direction from the lateral side 18 to the medial side 20.

With continued reference to FIG. 3, the second chamber 214 includes an eighth segment 218*h* extending along the medial side 20 from the mid-foot region 14. A ninth segment 218*i* includes a first portion extending from the eighth segment 218*h* on the medial side 20 and across the midsole to the lateral side 18, and a second portion extending along the lateral side through the heel region 16. A tenth segment 218*j* of the second chamber 214 extends around the heel region 16 from the eighth segment 218*h* on the medial side 20 to the ninth segment 218*i* on the lateral side 18. The tenth segment 218*j* may be fluidly coupled to each of the eighth segment 218*h* and the ninth segment 218*i* by third and fourth conduits 220*c*, 220*d*, respectively. As provided above, each of the segments 218*h*-218*j* and the conduits 220*c*, 220*d* of the second chamber 214 may be filled with a pressurized fluid to impart desirable properties of cushioning and responsiveness. Additionally or alternatively, the tenth segment 218*j* surrounding the heel region 16 may include a cushioning material to provide different cushioning characteristics from the pressurized fluids of the eighth and ninth segments 218*h*, 218*i*.

The third chamber 216 includes an eleventh segment 218*k* extending from the medial side 20 to the lateral side 18 around the toe portion of the forefoot region 12. A twelfth segment 218*l* extends from the eleventh segment 218*k* at the lateral side 18 towards the medial side 20 and terminates at a distal end 222*l* between the lateral side 18 and the medial side. The twelfth segment 218*l* is substantially parallel to the second segment 218*b*.

Figure 8:
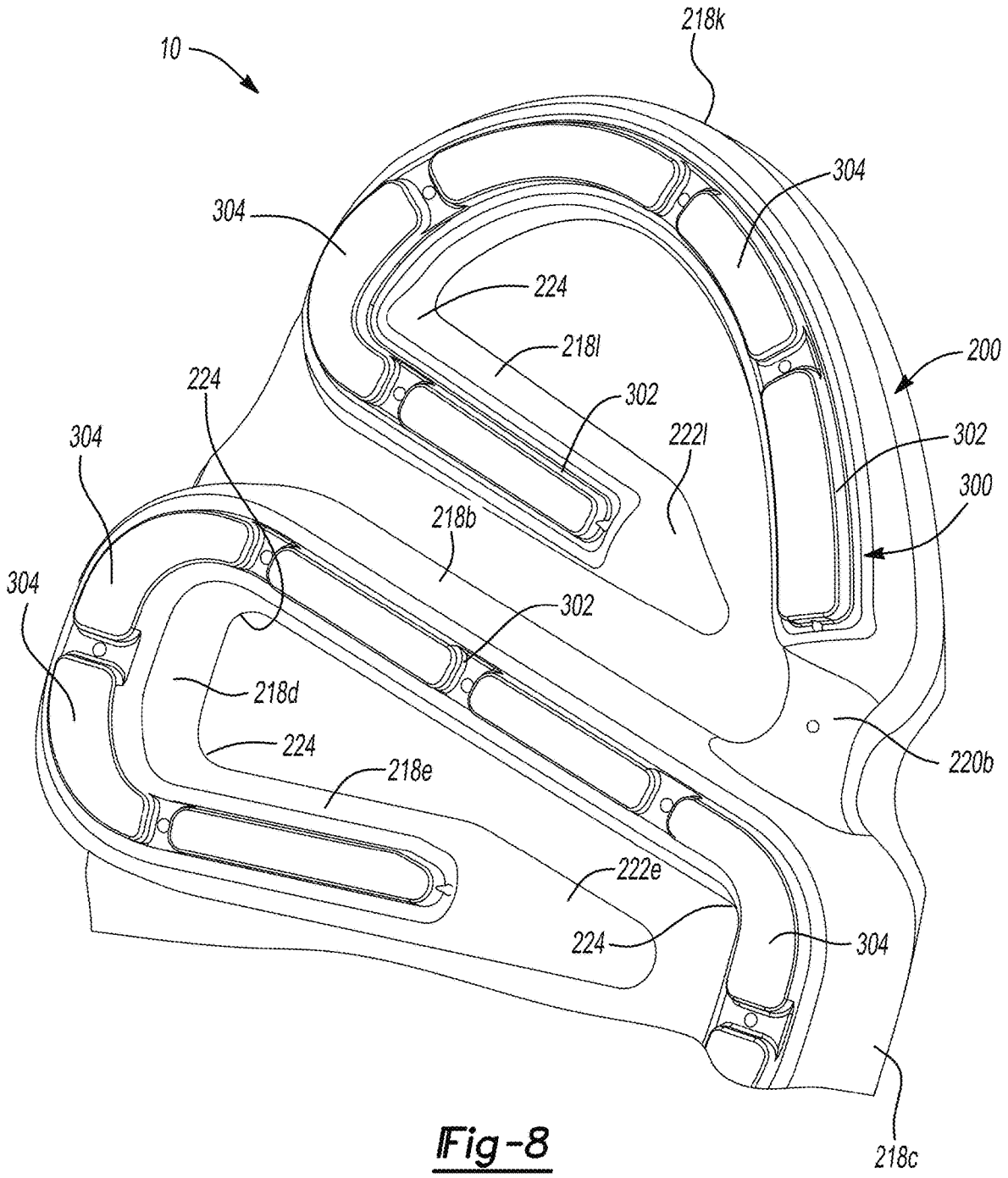
FIG. 8 is a perspective view of a segment having an outsole segment attached thereto.

As shown in FIGS. 3, 5, and 8 the distal ends 222*e*, 222*g*, 222*l* of the fifth, seventh, and twelfth segments 218*e*, 218*g*,

218*l* include a compound taper, wherein both the thickness T and a width of the segments decrease along a direction towards the distal end 222*e*, 222*g*, 222*l*. The tapered distal ends 222*e*, 222*g*, 222*l* operate as an anchor point for the respective segments 218*e*, 218*g*, 218*l*, as well as an anchor point for the bladder 202 as a whole, for retaining the shape thereof when loads such as shear forces are applied thereto.

In some examples, the segments 218*a*, 218*b*, 218*e*, 218*g*, 218*k*, 218*l* each extend generally along a direction from the lateral side 18 to the medial side 20, and are configured to compress in succession as the outsole 300 rolls for engagement with the ground surface while the footwear 10 is performing a running movement to provide cushioning for the foot. The web area 210 may separate the segments 218*a*, 218*b*, 218*e*, 218*g*, 218*k*, 218*l* from one another such that the web area 210 defines a flexion zone extending from the forefoot region 12 through the mid-foot region 14. Further, as described above, each of the segments 218*a*, 218*b*, 218*e*, 218*g*, 218*k*, 218*l* is either parallel to or convergent with each of the other segments 218*a*, 218*b*, 218*e*, 218*g*, 218*k*, 218*l* in a direction from the lateral side 18 to the medial side 20. The parallel and/or convergent arrangement of the segments 218*a*, 218*b*, 218*e*, 218*g*, 218*k*, 218*l* as well as the web area 210 separating the segments 218*a*, 218*b*, 218*e*, 218*g*, 218*k*, 218*l* allow the segments 218*a*, 218*b*, 218*e*, 218*g*, 218*k*, 218*l* to compress under an applied load to provide cushioning for the forefoot by attenuating ground-reaction forces during running movements, while simultaneously dampening oscillation by the foot while the segments 218*a*, 218*b*, 218*e*, 218*g*, 218*k*, 218*l* are under compression.

FIG. 4 provides a cross-sectional view taken along line 4-4 of FIG. 3 showing the midsole 200 in the forefoot region 12 with the insole 110, the strobel 104 of the upper 100, and the upper layer 204 of the bladder 202 arranged in the layered configuration as described above with reference to FIGS. 1 and 2. As provided above, the peripheral edges of the lower layer 206 may extend upward toward the upper 100 and join with the peripheral edges of the upper layer 204 to form the flange 208 along the medial side 20 and the lateral side 18. The lower layer 206 of the bladder 202 may also extend toward the upper 100 and join with the upper layer 204 to form a region of the web area 210 that extends between and separates the segments 218*k*, 218*l*. For instance, the segment 218*k* extending along the medial side 20 of the midsole 200 is bounded by the web area 210 and the flange 208 formed at the medial side 20, while the segment 218*l* extending from the segment 218*k* at the lateral side 18 toward the medial side 20 is bounded by the web area 210 and the flange 208 formed at the lateral side 18. The distal end 222*l* of the segment 218*l* tapers in the direction toward the upper 100 and terminates at the web area 210 formed at a location between the lateral side 18 and the medial side 20.

The outsole 300 attaches to and conforms in shape with each of the segments 218*k*, 218*l*. In some examples, the contact pad 302 extends from the outsole 300 in a direction away from the upper 100 and along respective lengths of the segments 218*k*, 218*l* to provide increased traction with the ground surface.

FIG. 5 provides a cross-sectional view taken along line 5-5 of FIG. 3 showing the midsole 200 in the forefoot region 12 with the insole 110, the strobel 104 of the upper 100, and the upper layer 204 of the bladder 202 arranged in the layered configuration as described above with reference to FIGS. 1 and 2. The peripheral edges of the lower layer 206 may extend upward toward the upper 100 and join with the peripheral edges of the upper layer 204 to form the flange 208 along the medial side 20 and the lateral side 18. The lower layer 206 of the bladder 202 may also extend toward the upper 100 and join with the upper layer 204 to form a region of the web area 210 that extends between and separates the segments 218*c*, 218*e*. For instance, the segment 218*c* extending along the medial side 20 of the midsole 200 is bounded by the web area 210 and the flange 208 formed at the medial side 20, while the segment 218*e* extending from the segment 218*d* at the lateral side 18 toward the medial side 20 is bounded by the web area 210 and the flange 208 formed at the lateral side 18. The distal end 222*e* of the segment 218*e* tapers in the direction toward the upper 100 and terminates at the web area 210 formed at the location between the lateral side 18 and the medial side 20.

The outsole 300 attaches to and conforms in shape with each of the segments 218*c*, 218*d*, 218*e*. In some examples, the contact pad 302 extends from the outsole 300 in a direction away from the upper 100 and along respective lengths of the segments 218*c*, 218*d*, 218*e* to provide increased traction with the ground surface.

FIG. 6 provides a cross-sectional view taken along line 6-6 of FIG. 3 showing the midsole 200 in the heel region 14 with the insole 110, the strobel 104, and the upper layer 204 of the bladder 202 arranged in the layered configuration as described above with reference to FIGS. 1 and 2. The peripheral edges of the lower layer 206 may extend upward toward the upper 100 and join with the peripheral edges of the upper layer 204 to form the flange 208 along the medial side 20 and the lateral side 18. Relative to the view of FIG. 6, the lower layer 206 protrudes away from the upper layer 204 in a direction away from the upper 100 to define the eighth segment 218*h* and the conduit 220*d* that extend along the medial side 20 and the lateral side 18 of the heel region 16, respectively. As shown, the lower layer 206 protrudes away from the upper layer 204 a greater distance at the medial side 20 than the lateral side 18. Accordingly, a thickness of the conduit 220*d* formed along the lateral side 18 is less than a thickness of the eighth segment 218*h*, wherein the lower layer 206 is recessed from the ground-contacting surface 304 of the contact pads 302.

FIG. 7 provides a cross-sectional view taken along line 7-7 of FIG. 3 showing the midsole 200 and outsole 300 extending through the heel region 16, the mid-foot region 14, and the forefoot region 12. The second chamber 214 extends along the medial side 20 of the midsole 200 within the heel region 16 and the mid-foot region 14. As described above with reference to the footwear 10 of FIGS. 1 and 2, the outsole 300 attaches to portions of the lower layer 206 in regions where the chambers 212, 214, 216 protrude away from the upper 100 to provide increased durability and resiliency for the bladder 202 in the heel region 16, the mid-foot region 14, and the forefoot region 12. Moreover, the segments 218*a*, 218*b*, 218*e*, 218*li*, 218*j*, 218*k*, 218*l* extend between the lateral side 18 and the medial side 20. The web area 210 may separate and extend between the segments 218*a*, 218*b*, 218*e*, 218*li*, 218*j*, 218*k*, 218*l* relative to the view of FIG. 7. In some examples, the segments 218*a*-218*g*, 218*k*, 218*l* extend into the forefoot region 12 and are associated with a smaller thickness than the segments 218*h*-218*j* in the heel region 16 and/or the mid-foot region 14.

FIG. 8 provides a bottom perspective view of the segments 218*b*-218*e*, 218*k*, 218*l* fluidly connected to one another and disposed within the forefoot region 12 of the midsole 200. In some examples, the segments 218*e*, 218*l* extend toward the medial side 20 to the distal ends 222*e*, 222*l* that terminate at a location between the lateral side 18 and the medial side 20. The distal ends 222*e*, 222*l* may taper in a direction toward the upper 100. The tapering by the distal end 222*e*, 222*l* of the segments 218*e*, 218*l* may function as an anchor point for the segments 218*e*, 218*l* when under an applied load, as described above.

Figure 9:
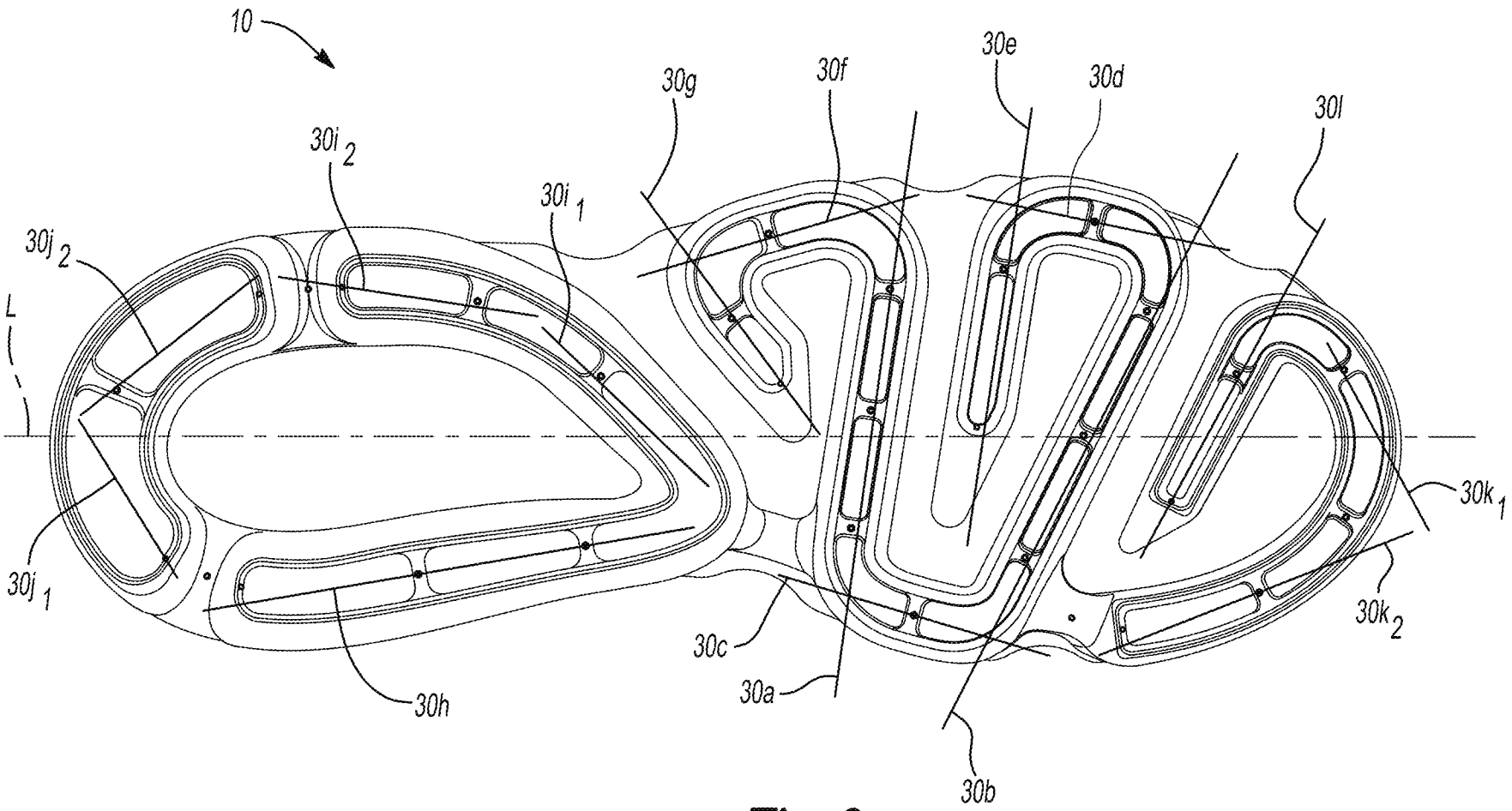
FIG. 9 is a bottom perspective view of the article of footwear of FIG. 1, showing cushioning support vectors defined by a fluid-filled bladder of a sole structure.

FIG. 9 provides a bottom perspective view of the article of footwear 10 of FIG. 1 showing a plurality of cushioning support vectors 30*a*-30*l* defined by the segments 218*a*-218*l*. More particularly, a longitudinal axis of each of the segments 218*a*-218*l* define respective ones of the cushioning support vectors 30*a*-30*l*. Applied loads associated with directions parallel to a cushioning support vector cause the one or more corresponding segments to substantially retain their shape without collapsing to provide support and stability for the foot in those regions. On the other hand, applied loads associated with directions transverse to a cushioning support vector cause the one or more corresponding segments to compress and collapse to provide cushioning for the foot in those regions by attenuating the ground-reaction force associated with the applied load. The longitudinal cushioning support vectors 30*c*, 30*d*, 30*f*, 30*h* may extend along the longitudinal axis L of the midsole 200 while the lateral cushioning support vectors 30*a*, 30*b*, 30*e*, 30*j*, and 30*l* extend transversely to the longitudinal axis L of the midsole 200. For instance, the lateral cushioning support vectors 30*a*, 30*b*, 30*e*, 30*j*, 301 may define angles within 15 degrees (15°) from perpendicular relative to the longitudinal axis L of the midsole 200. The seventh, ninth, tenth, and eleventh segments 218*g*, 218*i*-218*k* each define compound cushioning support vectors 30*g*, $30i_{1,2}$, $30j_{1,2}$, $30k_{1,2}$, whereby the angled and/or curved segments 218*g*, 218*i*-218*k* provide responsive support along both the longitudinal and lateral directions of the midsole 200.

During forward movements, such as walking or running movements, loads applied to the midsole 200 are associated with a direction parallel to the longitudinal cushioning support vectors 30*c*, 30*d*, 30*f*, 30*h* to cause the respective segments 218*c*, 218*d*, 218*f*, 218*h* to be under shear force, thereby causing the respective segments 218*c*, 218*d*, 218*f*, 218*h* to retain their shape (e.g., not compress) and provide support and stability as the outsole rolls for engagement with the ground surface through the heel region 16 and the mid-foot region 14. The web area 210 extending between the segments 218*c*, 218*d*, 218*f*, 218*h* reduces torsional forces from acting upon the segments 218*c*, 218*d*, 218*f*, 218*h* when under an applied load to thereby dampen oscillations by the foot while providing gradient responsive-type cushioning.

During lateral movements, such as shifting or cutting movements, loads applied to the midsole 200 are associated with a direction transverse and generally perpendicular to longitudinal cushioning support vectors 30*c*, 30*d*, 30*f*, 30*h*. Thus, the segments 218*c*, 218*h* defining one of the vectors 30*c*, 30*h* will compress to provide cushioning for the medial side of the foot when the applied load is in a direction toward the medial side 20 of the midsole 200, while the segments 218*d*, 218*f* defining the other vectors 30*d*, 30*f* will compress to provide cushioning for the lateral side of the foot when the applied load is in a direction toward the lateral side 18 of the midsole 200.

In some implementations, a series of lateral cushioning support vectors 30*c*, 30*d*, 30*f*, 30*h* are disposed within the mid-foot 14 and forefoot region 12 and extend substantially parallel to one another in a direction transverse to the longitudinal axis L of the midsole 200. During forward movements, such as walking or running movements, loads applied to the midsole 200 are associated with a direction transverse to the lateral cushioning support vectors 30*c*, 30*d*, 30*f*, 30*h*. Thus, the respective segments 218*c*, 218*d*, 218*f*, 218*h* defining respective ones of the vectors 30*c*, 30*d*, 30*f*, 30*h* successively compress and collapse to provide cushioning for the metatarsal region of the foot through push off from the ground-surface. The direction of the vectors 30*c*, 30*d*, 30*f*, 30*h* relative to the direction of the applied load as well as a length of the respective segments 218*c*, 218*d*, 218*f*, 218*h* dictates how the segments will compress for attenuating the ground-reaction force.

During lateral movements, such as shifting or cutting movements, loads applied to the midsole 200 are associated with a direction generally parallel or only slightly transverse to the lateral cushioning support vectors 30*c*, 30*d*, 30*f*, 30*h* to cause the respective segments 218*c*, 218*d*, 218*f*, 218*h* to be under shear force, thereby causing the respective segments 218*c*, 218*d*, 218*f*, 218*h* to retain the their shape (e.g., not compress or slightly compress) and provide support and stability for the metatarsal region of the foot responsive to the footwear 10 performing a lateral movement. With reference to FIG. 3, the distal ends 222 of the segments 218*e*, 218*g*, 218*l* may each taper in the direction toward the upper 100 and serve as anchor points for the bladder 202 as a whole.

As provided above, the midsole 200 further defines a series of compound cushioning support vectors 30*g*, 30*j*-30*l*, which are each configured to provide a degree of both longitudinal cushioning and responsiveness and lateral cushioning and responsiveness, thereby supplementing the lateral cushioning support vectors 30*c*, 30*d*, 30*f*, 30*h* and the longitudinal cushioning support vectors 30*c*, 30*d*, 30*f*, 30*h*.

The segments 218*a*-218*l* associated with the chambers 212, 214, 216 may cooperate to enhance the functionality and cushioning characteristics that a conventional midsole provides, while simultaneously providing increased stability and support for the foot by dampening oscillations of the foot that occur in response to a ground-reaction force during use of the footwear 10. For instance, an applied load to the midsole 200 during forward movements, such as walking or running movements, may cause some of the segments 218*a*-218*l* to compress to provide cushioning for the foot by attenuating the ground-reaction force, while other segments 218*a*-218*l* may retain their shape to impart stability and support characteristics that dampen foot oscillations relative to the footwear 10 responsive to the initial impact of the ground-reaction force.

Moreover, one or more of the segments 218*a*-218*l* may interact with the web area 210 within different regions 12, 14, 16 of the midsole 200 to provide isolated areas of responsive-type cushioning. For example, the segments 218*h*-218*j* within the heel region 16 may bound a respective portion of the web area 210 to provide responsive-type cushioning in the heel region 16 by causing the segments 218*h*-218*j* around the perimeter of the heel region 16 to absorb the initial impact of a ground-reaction force by creating a trampoline effect as the segments 218*j*-218*j* compress in succession, and thereby provide a gradient responsive-type cushioning in the heel region 16. The segments 218*j*-218*j* may cooperate with one another to surround a portion of the web area 210 at the heel region 16, thereby causing this portion of the web area 210 to act as a trampoline during use in an effort to absorb forces associated with a heel strike.

Additionally, the geometry and positioning of the segments 218*a*-218*l* along the midsole 200 may enhance traction between the outsole 300 and the ground surface during forward movements as the outsole 300 rolls for engagement with the ground surface from the heel region 16 to the forefoot region 12, as well as during lateral movements as the outsole 300 rolls for engagement with the ground surface from one of the lateral side 18 and the medial side 20 to the other one of the lateral side 18 and the medial side 20.

The following Clauses provide an exemplary configuration for an article of footwear described above.

Clause 1: A sole structure for an article of footwear having an upper, the sole structure comprising a heel region, a forefoot region, a mid-foot region disposed between the heel region and the forefoot region, and a bladder including a first barrier layer cooperating with a second barrier layer to define a first chamber having a first segment extending along one of a medial side of the sole structure and a lateral side of the sole structure, a second segment extending from a first end of the first segment to the other of the medial side and the lateral side, a third segment extending from a second end of the first segment to the other of the medial side and the lateral side and diverging from the second segment, and a fourth segment extending towards the heel region from one of the second segment and the third segment along the other of the medial side and the lateral side, and a fifth segment extending from the fourth segment towards the one of the medial side and the lateral side and terminating at a distal end between the medial side and the lateral side.

Clause 2: The sole structure of Clause 1, wherein the fourth segments extends from the second segment and the fifth segment extends between the second segment and the third segment.

Clause 3: The sole structure of Clause 2, wherein the fifth segment extends parallel to the third segment and converges with the second segment along a direction from the other of the medial side and the lateral side to the one of the medial side and the lateral side.

Clause 4: The sole structure of Clause 1, wherein the fourth segment extends from the third segment and the third segment extends between the second segment and the fifth segment.

Clause 5: The sole structure of Clause 4, wherein the fifth segment is convergent with the second segment and the third segment in a direction from the other of the medial side and the lateral side to the one of the medial side and the lateral side.

Clause 6: The sole structure of Clause 1, wherein the distal end of the fifth segment tapers in a direction toward the upper.

Clause 7: The sole structure of Clause 1, wherein the first chamber further includes a sixth segment extending towards the heel region from the other of the second segment and the third segment.

Clause 8: The sole structure of Clause 7, wherein the first chamber further includes a seventh segment extending from the sixth segment towards the one of the medial side and the lateral side and terminating at a distal end between the medial side and the lateral side.

Clause 9: The sole structure of Clause 8, wherein the fifth segment extends between the second segment and the third segment and the second segment is disposed between the fifth segment and the seventh segment.

Clause 10: The sole structure of Clause 1, wherein the bladder further includes a second chamber surrounding the heel region of the sole structure.

Clause 11: A sole structure for an article of footwear having an upper, the sole structure comprising a heel region, a forefoot region including a toe portion, a mid-foot region disposed between the heel region and the forefoot region, and a bladder including a first barrier layer cooperating with a second barrier layer to define a first chamber having a serpentine shape extending from a medial side of the sole structure to a lateral side of the sole structure within the forefoot region, a second chamber bounding a periphery of the heel region, a third chamber formed in the toe portion of the forefoot region, and a web area disposed between and connecting the first chamber, the second chamber, and the third chamber, the first barrier layer being attached to the second barrier layer within the web area.

Clause 12: The sole structure of Clause 11, wherein the first chamber is fluidly connected to the second chamber by a first conduit along the medial side and the third chamber is fluidly connected to the second chamber by a second conduit along the medial side.

Clause 13: The sole structure of Clause 11, wherein the first chamber includes a first segment extending along one of the medial side and the lateral side, a second segment extending from a first end of the first segment to the other of the medial side and the lateral side, a third segment extending from a second end of the first segment to the other of the medial side and the lateral side and diverging from the second segment, and a fourth segment extending towards the heel region from one of the second segment and the third segment along the other of the medial side and the lateral side, and a fifth segment extending from the fourth segment towards the one of the medial side and the lateral side and terminating at a distal end between the medial side and the lateral side.

Clause 14: The sole structure of Clause 13, wherein the third chamber includes a fifth segment extending around the toe portion from the one of the medial side and the lateral side to the other of the medial side and the lateral side, and a sixth segment extending from the fifth segment on the other of the medial side and the lateral side and towards the one of the medial side and the lateral side.

Clause 15: The sole structure of Clause 14, wherein the sixth segment terminates at a distal end between the medial side and the lateral side.

Clause 16: The sole structure of Clause 14, wherein the sixth segment is parallel to the second segment.

Clause 17: The sole structure of Clause 13, wherein the second chamber includes a fifth segment extending from the mid-foot region through the heel region along one of the medial side and the lateral side, a sixth segment extending from the first segment in the mid-foot region to the other of the medial side and the lateral side in the heel region, and a seventh segment extending around the heel region and fluidly coupling the fifth segment to the sixth segment.

Clause 18: The sole structure of Clause 17, wherein the seventh segment is fluidly coupled to the fifth segment by a third conduit and the seventh segment is fluidly coupled to the sixth segment by a fourth conduit.

Clause 19: The sole structure of Clause 11, further comprising an outsole attached to at least one of the first chamber, the second chamber, and the third chamber and defining a ground-engaging surface.

Clause 20: The sole structure of Clause 19, wherein the web area is recessed from the ground-engaging surface.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a heel region;

a forefoot region;

a mid-foot region disposed between the heel region and the forefoot region;

a bladder including a first bladder layer cooperating with a second bladder layer to define (i) a chamber having a first segment extending along one of a medial side of the sole structure and a lateral side of the sole structure, a second segment extending along the other of the medial side of the sole structure and the lateral side of the sole structure, and a third segment extending between and fluidly coupling the first segment and the second segment, the first segment and the second segment extending toward and being joined to one another at an acute angular junction disposed in the mid-foot region, the first segment extending along an arcuate path across the sole structure from the one of the medial side of the sole structure and the lateral side of the sole structure to the junction, and (ii) a web area extending continuously and uninterrupted between the first segment, the second segment, and the third segment; and an outsole attached to one of the first bladder layer of the bladder and the second bladder layer of the bladder.

2. The sole structure of claim 1, wherein the first segment includes a first distal end and the second segment includes a second distal end, the first distal end being joined to the second distal end at the junction.

3. The sole structure of claim 2, wherein the first segment extends in a direction toward the other of the medial side of the sole structure and the lateral side of the sole structure from the heel region to the first distal end.

4. The sole structure of claim 2, wherein the first segment extends from the heel region to the first distal end and the second segment extends from the heel region to the second distal end.

5. The sole structure of claim 1, wherein the third segment is arcuate.

6. The sole structure of claim 1, wherein the third segment extends along a posterior end of the sole structure within the heel region.

7. The sole structure of claim 1, wherein the first segment, the second segment, and the third segment cooperate to define a closed loop in the heel region.

8. An article of footwear incorporating the sole structure of claim 1.

9. A sole structure for an article of footwear, the sole structure comprising:

a heel region;

a forefoot region;

a mid-foot region disposed between the heel region and the forefoot region;

a bladder including a first bladder layer cooperating with a second bladder layer to define (i) a chamber having a first segment extending along one of a medial side of the sole structure and a lateral side of the sole structure, a second segment extending along the other of the medial side of the sole structure and the lateral side of the sole structure, and a third segment extending between and fluidly coupling the first segment and the second segment, the first segment extending along an arcuate path across the sole structure from the one of the medial side of the sole structure and the lateral side of the sole structure in a direction toward the other of the medial side of the sole structure and the lateral side of the sole structure and being joined to the second segment at the other of the medial side of the sole structure and the lateral side of the sole structure at an acute angular junction, and (ii) a web area extending continuously and uninterrupted between the first segment, the second segment, and the third segment; and an outsole attached to one of the first bladder layer of the bladder and the second bladder layer of the bladder.

10. The sole structure of claim 9, wherein the junction is disposed in the mid-foot region.

11. The sole structure of claim 9, wherein the first segment includes a first distal end and the second segment includes a second distal end, the first distal end being joined to the second distal end at the junction.

12. The sole structure of claim 11, wherein the first segment extends from the heel region to the first distal end and the second segment extends from the heel region to the second distal end.

13. The sole structure of claim 9, wherein the third segment is arcuate.

14. The sole structure of claim 9, wherein the third segment extends along a posterior end of the sole structure within the heel region.

15. The sole structure of claim 9, wherein the first segment, the second segment, and the third segment cooperate to define a closed loop in the heel region.

16. An article of footwear incorporating the sole structure of claim 9.

* * * * *